US006641421B1

(12) United States Patent
Leavitt et al.

(10) Patent No.: US 6,641,421 B1
(45) Date of Patent: Nov. 4, 2003

(54) HIGH-VOLTAGE ELECTRICAL CONNECTOR AND RELATED METHOD

(75) Inventors: Chase L. Leavitt, Playa del Rey, CA (US); Stephen W. Good, Hawthorne, CA (US)

(73) Assignee: Reynolds Industries, Inc., Los Angeles, CA (US)

( * ) Notice: Subject to any disclaimer, the term of this patent is extended or adjusted under 35 U.S.C. 154(b) by 0 days.

(21) Appl. No.: 10/238,811

(22) Filed: Sep. 9, 2002

(51) Int. Cl.[7] ..... H01R 13/52
(52) U.S. Cl. ..... 439/271; 439/272
(58) Field of Search ..... 439/271, 272, 439/273, 274, 275, 276, 277, 278, 279, 281, 282

(56) References Cited

U.S. PATENT DOCUMENTS

| | | | | | |
|---|---|---|---|---|---|
| 3,474,386 | A | | 10/1969 | Link | 339/60 |
| 3,555,487 | A | | 1/1971 | Jones | 339/60 |
| 3,621,448 | A | * | 11/1971 | Arnold et al. | 439/272 |
| 3,678,441 | A | * | 7/1972 | Upstone et al. | 439/272 |
| 3,835,439 | A | | 9/1974 | Yonkers | 339/19 |
| 3,904,264 | A | | 9/1975 | Oertle | 339/94 |
| 4,417,736 | A | | 11/1983 | Herrmann, Jr. | 277/212 R |
| 4,605,272 | A | | 8/1986 | Myers et al. | 339/60 |
| 4,820,181 | A | * | 4/1989 | Kuzuno et al. | 439/272 |
| 4,986,764 | A | | 1/1991 | Eaby et al. | 439/275 |
| 5,354,221 | A | | 10/1994 | Doherty, II et al. | 439/683 |
| 5,580,266 | A | * | 12/1996 | Shelly | 439/281 |
| 5,595,496 | A | | 1/1997 | Konda et al. | 439/271 |
| 5,626,486 | A | * | 5/1997 | Shelly et al. | 439/273 |
| 6,443,764 | B2 | * | 9/2002 | Makita | 439/272 |
| 6,475,008 | B1 | * | 11/2002 | Marolda et al. | 439/271 |

* cited by examiner

*Primary Examiner*—Dean A. Reichard
*Assistant Examiner*—Angel R. Estrada
(74) *Attorney, Agent, or Firm*—Sheppard, Mullin, Richter & Hampton LLP

(57) ABSTRACT

An improved electrical connector configured to couple high-voltage signals with minimal risk of corona discharge includes a plug assembly having a cylindrical nose and a receptacle assembly having a cylindrical cavity, with a cup-shaped resilient seal carried either in the cavity or on the nose. The seal is sized such that the nose can be manually inserted fully into the cavity while encountering only minimal mechanical resistance. Thereafter the seal's cylindrical side wall is longitudinally compressed, to increase its radial thickness and thereby substantially fill the annular space between the nose the cavity side wall. The connector thus can be coupled and uncoupled with only minimal insertion forces and with substantially reduced risk of mechanical damage.

17 Claims, 3 Drawing Sheets

HIGH-VOLTAGE ELECTRICAL CONNECTOR AND RELATED METHOD

BACKGROUND OF THE INVENTION

This invention relates generally to electrical connectors and, more particularly, to electrical connectors configured to carry high voltages while providing limited mechanical resistance to coupling and uncoupling.

Examples of electrical connectors of this particular kind are disclosed in U.S. Pat. No. 4,605,272 issued to Myers et al. One of the connectors disclosed in the patent includes mating connector halves in the form of a plug assembly and a receptacle assembly, each carrying an electrical contact configured to mate with the other. The plug assembly includes a dielectric sleeve having a cylindrical nose and carrying a female contact, or contact socket, coaxially within the nose. The receptacle assembly includes a dielectric receptacle insulator having a cylindrical cavity and carrying a male contact, or contact pin, coaxially within the cavity. The receptacle assembly further includes a resilient sleeve, or seal, located within the cavity, concentric with the cavity's cylindrical side wall.

In use, the plug assembly is mated with the receptacle assembly by mechanically inserting the nose of the plug assembly into the resilient seal located within the cavity of the dielectric receptacle insulator. This couples together the contacts of the two assemblies. The resilient seal is specially configured such that, when the two assemblies are mated, the seal substantially fills the annular space between the concentric side walls of the plug assembly's nose and the side wall of the receptacle assembly's cavity. In this mated condition, a series of aligned circumferential ribs in the seal's inner and outer surfaces are compressed radially, to provide a reliable dielectric seal. By substantially filling the annular space between the two concentric side walls, the risk of undesired corona discharge is minimized.

One important feature of the electrical connector of the Myers et al. patent is that only the annular ribs of the resilient seal are radially compressed between the concentric side walls when the plug and receptacle assemblies are coupled together. Consequently, the seal provides only limited mechanical resistance to coupling and uncoupling of the two assemblies. Nevertheless, this limited mechanical resistance is considered excessive, especially in the case of connectors having multiple contacts. The need to overcome this mechanical resistance can require unduly high insertion forces and, in some cases, can even damage the resilient seal.

It should, therefore, be appreciated that there is a need for an improved electrical connector configured to reliably couple high-voltage electrical signals while offering even lower mechanical resistance to coupling and uncoupling. The present invention fulfills this need and provides further related advantages.

SUMMARY OF THE INVENTION

The present invention is embodied in an improved electrical connector having mating plug and receptacle assemblies configured to reliably couple high-voltage electrical signals while offering only insubstantial mechanical resistance to coupling and uncoupling. The plug assembly includes: (1) a plug insulator having a nose, (2) an electrical contact supported within the nose of the plug insulator, and (3) a seal compressor. The receptacle assembly includes: (1) a receptacle insulator having a cavity defined by a side wall, and (2) an electrical contact supported within the cavity. Both the plug insulator and the receptacle insulator are formed of a substantially non-resilient dielectric material. When the plug assembly and receptacle assembly are engaged with each other, the nose is positioned within the cavity and the contacts are electrically coupled to each other, at which time an annular space is define between the nose and the cavity wall. The connector further includes a resilient dielectric seal fitted either onto the nose of the plug assembly or within the cavity of the receptacle assembly, such that the seal is interposed in the annular space define between the nose and the cavity wall when the plug assembly and receptacle assembly are engaged with each other. The seal has a prescribed nominal radial thickness profile sized such that the plug assembly and receptacle assembly can be couple to each other without substantial sliding resistance. The seal compressor of the plug assembly is operable when the plug assembly and receptacle assembly are coupled together, to increase the nominal radial thickness profile of the resilient dielectric seal until the seal substantially fills the annular space between the nose and the cavity wall.

In more detailed features of the invention, the resilient dielectric seal and the seal compressor both are substantially cylindrical. The seal compressor is part of a plug body, and it is configured to encircle a portion of the nose and to engage one end of the resilient dielectric seal. Further, the plug assembly and receptacle assembly, together, further include a rotatable coupling nut and mating threads, for tightening the engagement between the two assemblies and simultaneously moving the cylindrical seal compressor relative to the nose, to compress the resilient dielectric seal longitudinally. Rotation of the coupling nut relative to the mating threads advances the cylindrical seal compressor toward the receptacle assembly, while the plug insulator and nose retract relative to it. Means also are included, e.g., a compression spring, for yieldably resisting retraction of the nose relative to the cylindrical seal compressor.

In other more detailed features of the invention, the resilient dielectric seal has nominal radial thickness profile that is substantially uniform around its entire circumference. The seal also can include a plurality of circumferential ribs, to enhance the dielectric seal it provides. Preferably, the seal is formed of silicone rubber.

Other features and advantages of the present invention should become apparent from the following description of the preferred embodiments, taken in conjunction with the accompanying drawings, which illustrate, by way of example, the principles of the invention.

DESCRIPTION OF THE PREFERRED EMBODIMENTS

Figures 1, 2, 3, 4:
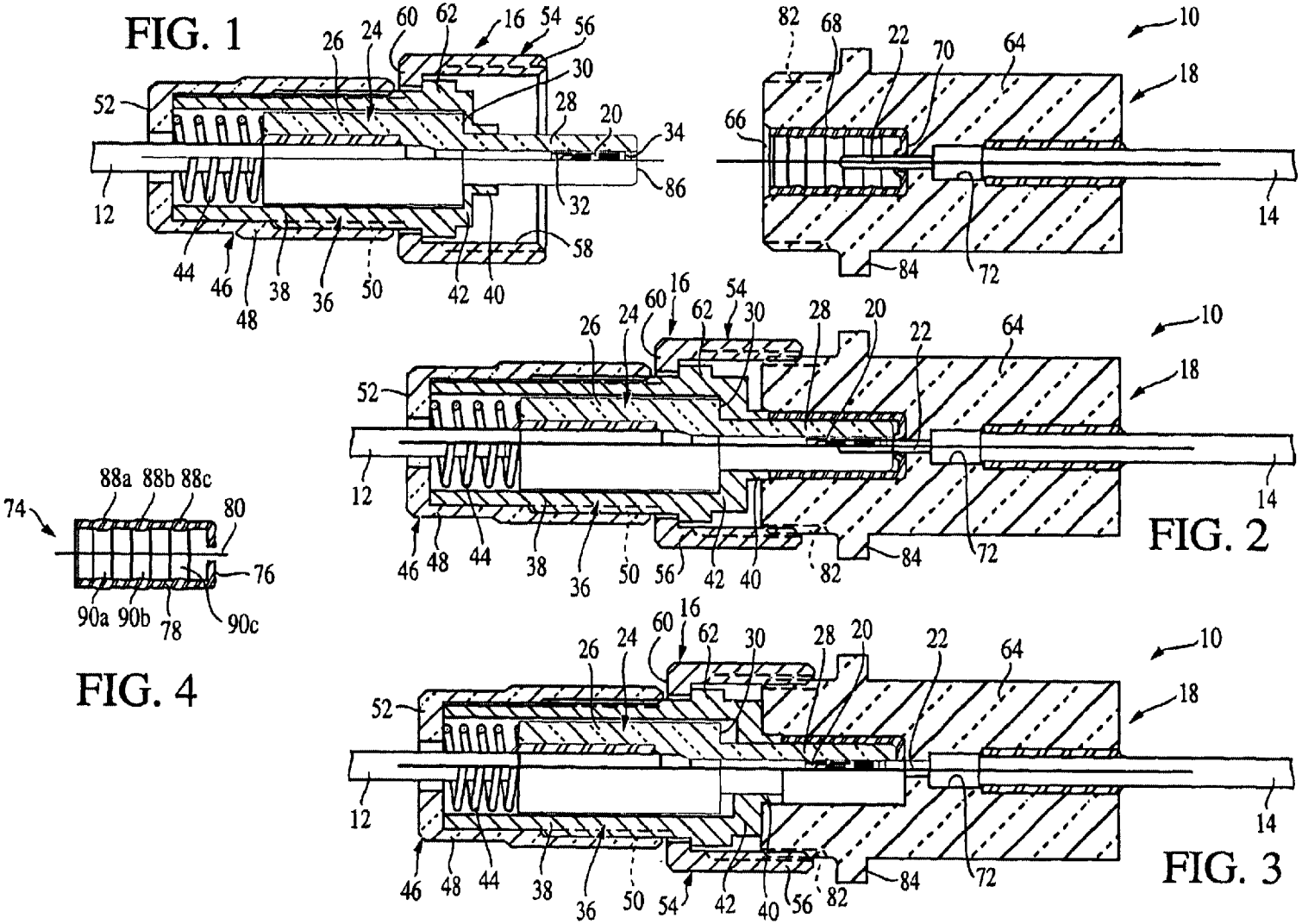
FIG. 1 is a cross-sectional view of a first embodiment of an electrical connector in accordance with the invention, showing the connector's plug assembly and receptacle assembly uncoupled from each other, this embodiment having a resilient dielectric seal carried within a cylindrical cavity of the receptacle assembly.
FIG. 2 is a cross-sectional view of the electrical connector of FIG. 1, showing the plug assembly and receptacle assembly in a partially coupled condition.
FIG. 3 is a cross-sectional view of the electrical connector of FIG. 1, showing the plug assembly and receptacle assembly in their fully coupled condition.
FIG. 4 is a cross-sectional view of the resilient dielectric seal that is carried within the cylindrical cavity of the receptacle assembly of the connector embodiment of FIGS. 1–3.

With reference now to the illustrative drawings, and particularly to FIGS. 1–3, there is shown an electrical connector 10 configured to couple a high-voltage electrical signal from a first cable 12 to a second cable 14, while minimizing a risk of undesired corona discharge. The connector includes a plug assembly 16 and a receptacle assembly 18, configured to mate with each other and thereby to couple a high-voltage electrical signal between a female contact 20 of the plug assembly and a male contact 22 of the receptacle assembly. A rearward end of the plug assembly's contact connects to the first cable, and a rearward end of the receptacle assembly's contact connects to the second cable.

The plug assembly 16 includes a rigid plug insulator 24 having a cylindrical base 26 and a cylindrical nose 28, with a shoulder 30 being defined between them. The female contact 20 is carried within a central cavity 32 of the plug insulator, extending longitudinally along its entire length. A forward end of this female contact is exposed through a circular opening 34 at the nose's forward end. The plug insulator can be formed of any conventional dielectric material.

Surrounding the plug insulator 24 is an outer plug body 36, which includes a cylindrical base 38 located concentrically around the base 26 and a cylindrical extension 40, of smaller diameter, located around a rearward portion of the nose 28. A step-down ring 42 connects the base 38 with the extension 40, and all three portions of the plug body are integrally formed of any conventional dielectric material, or even a metal.

The plug assembly 16 further includes a coil spring 44 located rearward of the plug insulator 24 and a cup-shaped spring retainer 46 located rearward of the coil spring. The spring retainer includes a cylindrical portion 48 that is secured to the plug body 36 by screw threads 50. The spring retainer further includes an integral, ringshaped end wall 52 at the rearward end of the cylindrical portion 48, for providing a rearward stop for the coil spring. The coil spring thereby supplies a continuous forward bias force for the plug insulator 24. Forward movement of the plug insulator is arrested by engagement of the plug insulator's shoulder 30 with the plug body's step-down ring 42.

A coupling nut 54 encircles a forward end of the plug body 36. This coupling nut includes a cylindrical forward portion 56 having internal threads 58, and it further includes in inwardly projecting flange 60 located at the rearward end of such forward portion. The flange retains the coupling nut behind a corresponding flange 62 projecting outwardly from the plug body's cylindrical base 38. The coupling nut is freely rotatable around the plug body, and its threads are configured for threaded engagement with the receptacle assembly 18.

The receptacle assembly 18 includes a rigid dielectric receptacle insulator 64 defining a cylindrical cavity 66 at its forward end. The cavity includes a cylindrical side wall 68 and a disk-shaped end wall 70. The male contact 22 of the receptacle assembly is carried within a central cavity 72 of the receptacle insulator, extending longitudinally along its entire length. A forward end of the male contact projects forwardly from the center of the cavity's disk-shaped end wall, concentric with the cavity.

The receptacle assembly 18 further includes a cup-shaped, resilient seal 74 sized to fit snugly within the cylindrical cavity 66. The seal can be formed of any conventional elastomeric material, e.g., silicone rubber, and it preferably is a solid material, without any air pockets. A ring-shaped end wall 76 of the seal abuts against the cavity's end wall 70, and a cylindrical side wall 78 of the seal abuts against the cavity's side wall 68. A central opening 80 in the seal's end wall accommodates the forward-projecting contact 22.

Threads 82 are formed at the forward end of the dielectric receptacle insulator 64, for threaded engagement with the threads 58 of the coupling nut 54 of the plug assembly 16. The receptacle insulator also can include an integral flange 84 projecting outward from a location immediately rearward of the threads. This flange facilitates a convenient gripping of the receptacle assembly 18 when it is being coupled or uncoupled from the plug assembly 16. The flange also can facilitate mounting of the receptacle assembly to a support structure (not shown). Optionally, the receptacle assembly can further include an outer metal body (not shown) surrounding the receptacle insulator.

The plug assembly 16 and receptacle assembly 18 are coupled together by manually inserting the nose 28 of the plug assembly's plug insulator 24 into the receptacle assembly's cavity 66. The nose is sized such that it can slide freely into the interior space of the resilient seal 74 without encountering significant frictional resistance. Part way into the insertion, the plug assembly's female contact 20 will engage the receptacle assembly's male contact 22. When this occurs, limited mechanical resistance will be encountered as the arms of the female contact are spread apart to receive the male contact. Thereafter, continued insertion of the nose into the seal will be mechanically resisted substantially only by sliding friction of the mated contacts. It will be appreciated that, in an alternative embodiment, the female contact could be carried on the receptacle assembly and the male contact could be carried on the plug assembly.

Eventually, manual insertion of the nose 28 and into the cavity 66 will reach a position where a forward end 86 of the nose contacts the end wall 76 of the resilient seal 74 . This occurs at about the same time that the forward end of the extension 40 of the plug body 36 contacts the forward end of the resilient seal's cylindrical wall 78. This position is depicted in FIG. 2.

After the position depicted in FIG. 2 has been reached, further engagement of the plug assembly 16 and receptacle assembly 18 is accomplished by threading the plug assembly's coupling nut 54 onto the receptacle assembly's threads 82. This action initially draws the forward end of the nose 28 into compressive engagement with the end wall 76 of the resilient seal 74. Further threading of the coupling nut advances the plug body 36 toward the receptacle insulator 64, while the plug insulator 24 retracts relative to the plug body, against the yielding bias of the coil spring 44. The spring provides sufficient force, e.g., about 5 pounds, to overcome the mechanical resistance of the mating contacts 20 and 22. It will be appreciated that other forms of compression springs, including wave springs, could be substituted for the coil spring.

As the plug insulator 24 retracts relative to the plug body 36, the extension 40 of the plug body compressively engages the forward end of the resilient seal's cylindrical side wall 78. This compresses the side wall longitudinally and, thereby, increases the side wall's radial thickness. The extension thus functions as a seal compressor. Eventually, the wall thickness will be increased to a point where the seal fills substantially the entire annular space between the cylindrical side wall of the nose 28 and the cylindrical side wall 68 of the cavity 66. In this position, depicted in FIG. 3, the plug assembly 16 and receptacle assembly 18 are fully engaged. The seal preferably undergoes a maximum total longitudinal compression in the range of about 10 to 25% of the seal's uncompressed length.

FIG. 4 depicts the resilient seal 74 of the electrical connector 10 of FIGS. 1–3. It will be noted that the seal includes a set of annular ribs 88*a*, 88*b*, and 88*c* spaced along the length of the inner surface of the side wall 78, and an aligned set of annular ribs 90*a*, 90*b*, and 90*c* similarly spaced along the length of the outer surface of the side wall. These ribs function to provide an improved seal between the nose 28 of the plug assembly 16 and the cavity 66 of the receptacle assembly 18. The ribs also ensure that a slight amount of air remains between the seal and the nose, and between cavity and the cavity side wall. The presence of this air minimizes the possibility of temperature-induced damage to the connector resulting from differential expansion of the connector's various components.

Figure 5:
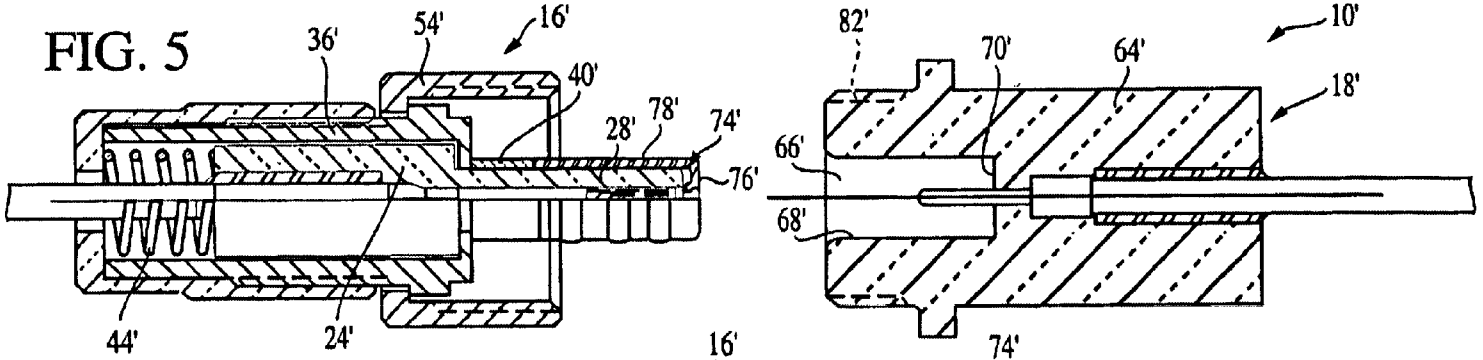
FIG. 5 is a cross-sectional view of a second embodiment of an electrical connector in accordance with the invention, showing the connector's plug assembly and receptacle assembly uncoupled from each other, this embodiment having a resilient seal carried on a cylindrical nose of the plug assembly.
Figure 6:
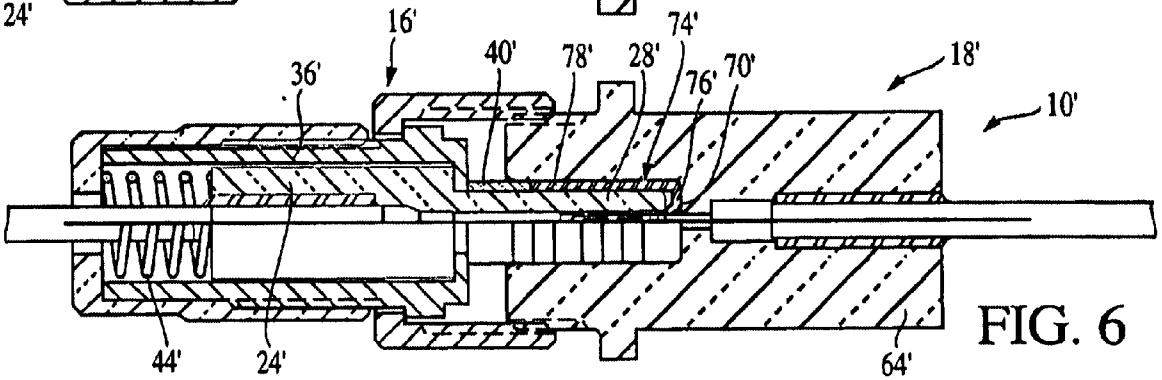
FIG. 6 is a cross-sectional view of the electrical connector of FIG. 5, showing the plug assembly and receptacle assembly in a partially coupled condition.
Figure 7:
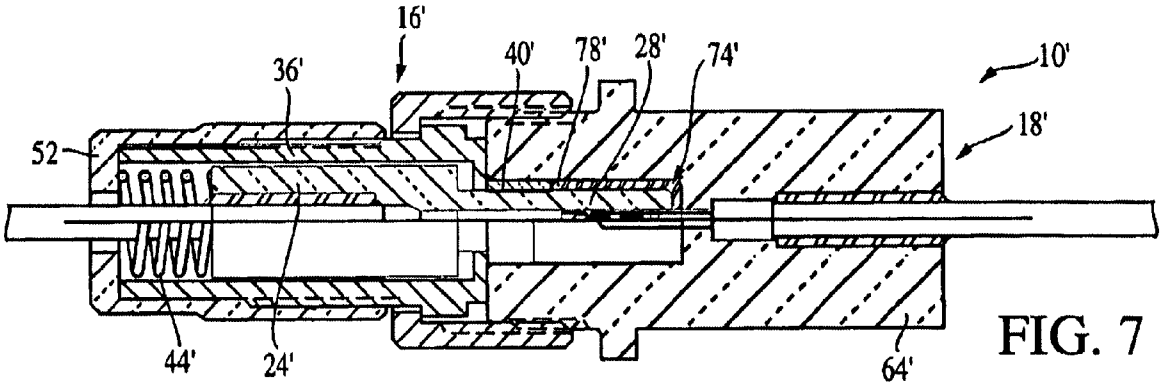
FIG. 7 is a cross-sectional view of the electrical connector of FIG. 5, showing the plug assembly and receptacle assembly in their fully coupled condition.

A second embodiment of an electrical connector 10' in accordance with the invention is depicted in FIGS. 5–7. This embodiment is substantially similar to the electrical connector 10 of FIGS. 1–3. Components of the connector 10' of FIGS. 5–7 corresponding to similar components of the connector 10 of FIGS. 1–3 are identified in the drawings using the sane reference numeral, but accompanied by a hyphen. The electrical connector 10' of FIGS. 5–7 differs from the electrical connector 10 of FIGS. 1–3 in that the resilient seal 74' is carried on the nose 28' of the plug assembly 16'. A suitable adhesive can optionally be used to supplement the seal's friction fit. In addition, a separate ring-shaped seal compressor 40' (FIGS. 5–7) is substituted for the integral plug body extension 40 (FIGS. 1–3).

Coupling of the plug assembly 16' and receptacle assembly 18' is accomplished in a manner substantially similar to the manner for coupling the plug and receptacle assemblies of the electrical connector 10 of FIGS. 1–3. In particular, the nose 28' and resilient seal 74' are manually inserted into the receptacle assembly's cavity 66'. The seal is sized such that it can slide freely into the cavity without encountering significant frictional resistance. Eventually, manual insertion of the nose and seal into the cavity will reach a position where the seal's end wall 76' engages the cavity's rearward end wall 70'. This position is depicted in FIG. 6.

After the position depicted in FIG. 6 has been reached, further engagement of the plug assembly 16' and receptacle assembly 18' is accomplished by threading the plug assembly's coupling nut 54' onto the receptacle assembly's threads 82'. This action initially compresses the end wall 76' of the resilient seal 74' against the end wall 70' of the cavity 66'. Further threading of the coupling nut advances the plug body 36' toward the receptacle insulator' 64', while the plug insulator 24' retracts relative to the plug body, against the yielding bias of the coil spring 44'. As this occurs, the seal compressor 40' compressively engages the rearward end of the resilient seal's cylindrical side wall 78', which compresses the side wall longitudinally and, thereby, increases the side wall's radial thickness. Eventually, the wall thickness will be increased to a point where the seal fills substantially the entire annular space between the side wall of the nose 28' and the side wall 68' of the cavity 66'. This fully engaged position is depicted in FIG. 7.

Figure 8:
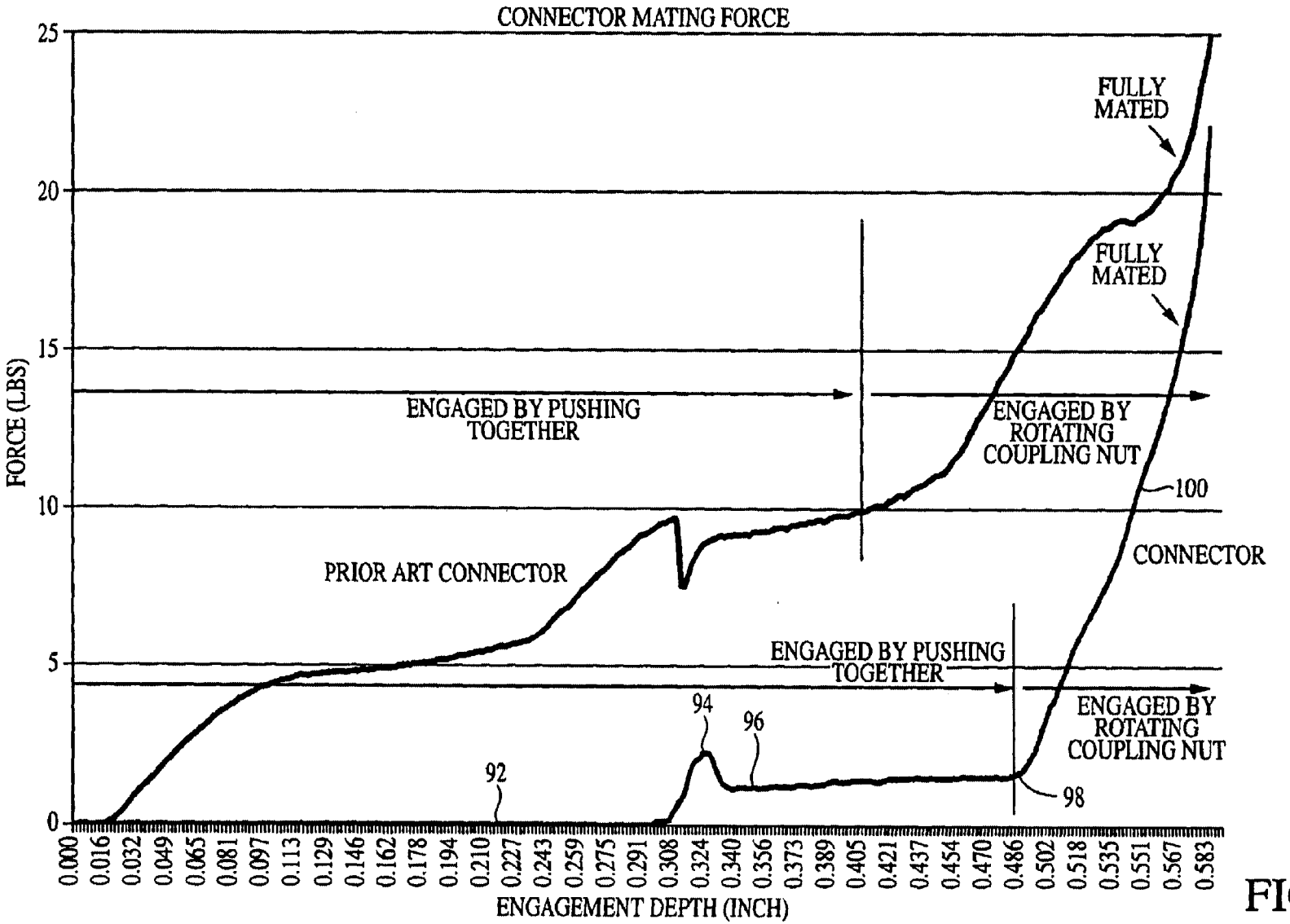
FIG. 8 is a graph depicting the mating force required to couple together the plug assembly and receptacle assembly of the electrical connector embodiments of FIGS. 1–3 and 5–7, as compared with the mating force required to couple together plug assembly and receptacle assembly of a prior art electrical connector.

FIG. 8 is a graph depicting the longitudinal force required to couple together the plug assembly 16 and receptacle assembly 18 of the electrical connector 10 of FIGS. 1–3 (or the plug assembly 16' and receptacle assembly 18' of the electrical connector 10' of FIGS. 5–7), as a function of engagement depth. It will be noted that the initial insertion of the-plug assembly's nose 28 into the receptacle assembly's cavity 66 encounters substantially no mechanical resistance. Consequently, the required insertion force is substantially zero, as indicated by the reference numeral 92 in FIG. 8.

When the nose 28 has been inserted to a depth where the plug assembly's female contact 20 first engages the receptacle assembly's male contact 22, a limited mechanical resistance is encountered. This reflects the engagement force between the two contacts, and it is indicated by the reference numeral 94 in FIG. 8. Thereafter, continued insertion of the nose into the cavity 66 is resisted substantially only by sliding friction between the mated contacts. This sliding friction is indicated by the reference numeral 96.

The nose 28 eventually is inserted into the cavity 66 to a position where the nose's forward end engages the end wall 76 of the resilient seal 74. This position is indicated by the reference numeral 98 in FIG. 8. Substantial mechanical resistance to insertion beyond this position is provided by compression of the seal's end wall and by longitudinal compression of the seal's side wall 78. This is indicated by the reference numeral 100. A fully mated condition is achieved after a coupling force of about 16 pounds has been provided. Significantly, this coupling force is provided using the coupling nut 54, which inherently provides a significant lever advantage. The maximum coupling force required at a time when the plug assembly 16 and receptacle assembly 18 are simply being manually pushed longitudinally together is only about two pounds.

Also depicted in FIG. 8 is a graph of the insertion force required to couple a standard single-contact connector of the prior art, in particular, a connector embodying the invention disclosed in the identified Myers et al. patent. It will be noted that the connector is fully mated only after a coupling force of about 21 pounds has been provided. Additionally, and most significantly, a coupling force of about ten pounds is required just to engage the connector halves sufficiently to allow use of a coupling nut. This excessive force largely results from frictional engagement with the connector's resilient seal. The connector of the invention avoids this drawback by configuring the connector to increase the resilient seal's radial thickness only after the connector halves have engaged each other to a point where further coupling is accomplished using a coupling nut.

The invention also has applicability to embodiments of electrical connectors having multiple contacts. In those alternative embodiments, a separate cylindrical nose and cavity are provided for each mating pair of contacts. In addition, a separate cup-shaped resilient seal is provided for each such pair. In the connector's uncoupled condition, each seal can be carried either on the nose or in the cavity. Coupling of the two multi-contact connector halves is accomplished in the same manner as the connectors of FIGS. 1–3 and 5–7. As this coupling occurs, longitudinal compression of the cylindrical side wall of each resilient seal increases the side wall's radial thickness and thereby substantially fills the annular space between each nose and its corresponding cavity.

Multi-contact electrical connectors particularly benefit from the invention because of the significantly reduced longitudinal force required to couple together the two connector halves. Without the invention, the mechanical resistance provided by the structure associated with each associated pair of contacts could require the application of excessive coupling forces, in some cases even causing damage to the resilient seals.

It should be appreciated from the foregoing description that the present invention provides an improved electrical connector configured to couple high-voltage signals with minimal risk of corona discharge. The connector includes a plug assembly having a cylindrical nose and a receptacle assembly having a cylindrical cavity, with a cup-shaped resilient seal carried either in the cavity or on the nose. The seal is sized such that the nose can be manually inserted fully into the cavity while encountering only minimal mechanical resistance. Thereafter the seal's cylindrical side wall is longitudinally compressed, to increase its radial thickness and thereby substantially fill the annular space between the concentric walls of the nose and the cavity.

Although the invention has been described in detail with reference only to the preferred embodiments, it will be appreciated that various modifications can be made without departing from the invention. Accordingly, the invention is defined only by the following claims.

We claim:

1. An electrical connector comprising:

(a) a plug assembly including
  (1) a plug insulator formed of a substantially non-resilient dielectric material and including a nose,
  (2) an electrical contact supported within the nose of the plug insulator, and
  (3) a seal compressor;

(b) a receptacle assembly including
  (1) a receptacle insulator formed of a substantially non-resilient dielectric material and having a cavity defined by a side wall, and
  (2) an electrical contact supported within the cavity of the receptacle insulator;

(c) wherein the plug assembly and receptacle assembly are configured to be engageable with each other, with the contact of the plug assembly electrically coupled with the contact of the receptacle assembly, and with the nose positioned within the cavity, an annular space being defined between the nose and the cavity side wall; and (d) a resilient dielectric seal fitted either onto the nose of the plug assembly or within the cavity of the receptacle assembly, such that the seal is interposed in the annular space defined between the nose and the cavity side wall when the plug assembly and receptacle assembly are engaged with each other, wherein the seal has a prescribed nominal radial thickness profile sized such that the plug assembly and receptacle assembly can engage each other without substantial sliding resistance;

(e) the seal compressor of the plug assembly is operable when the plug assembly and receptacle assembly are engaged with each other, to increase the nominal radial thickness profile of the resilient dielectric seal until the seal substantially fills the annular space between the nose and the cavity side wall.

2. An electrical connector as defined in claim 1, wherein:

the resilient dielectric seal is substantially cylindrical; and the seal compressor is substantially cylindrical and is configured to engage one end of the resilient dielectric seal, to compress the seal longitudinally.

3. An electrical connector as defined in claim 2, wherein the cylindrical seal compressor encircles a portion of the nose and is movable longitudinally relative to the nose.

4. An electrical connector as defined in claim 3, wherein the plug assembly and receptacle assembly, together, further include a rotatable coupling nut and mating threads, for tightening the engagement between the two assemblies and simultaneously moving the cylindrical seal compressor relative to the nose, to compress the resilient dielectric seal longitudinally.

5. An electrical connector as defined in claim 4, wherein:

the plug assembly further includes a plug body encircling a portion of the nose;

rotation of the coupling nut relative to the mating threads advances the plug body and the cylindrical seal compressor toward the receptacle assembly while the plug insulator and nose retract relative thereto; and the plug assembly further includes means for yieldably resisting retraction of the nose relative to the plug body and cylindrical seal compressor.

6. An electrical connector as defined in claim 5, wherein:

the means for yieldably resisting retraction of the nose includes a compression spring; and the plug body and the cylindrical seal compressor are integral with each other.

7. An electrical connector as defined in claim 1, wherein the resilient dielectric seal is substantially cylindrical and its nominal radial thickness profile is substantially uniform around its entire circumference.

8. An electrical connector as defined in claim 7, wherein the resilient dielectric seal includes a plurality of circumferential ribs.

9. An electrical connector as defined in claim 1, wherein the resilient dielectric seal is formed of silicone rubber.

10. An electrical connector comprising:

a plug assembly including
  a plug insulator having a cylindrical nose, the plug insulator being formed of a substantially non-resilient dielectric material,
  an electrical contact supported within the plug insulator and exposed through a central opening formed in a forward end of the cylindrical nose, and
  a plug body having a cylindrical seal compressor encircling at least a portion of the cylindrical nose;

a receptacle assembly including
  a receptacle insulator having a side wall that defines a cylindrical cavity, the receptacle insulator being formed of substantially non-resilient dielectric material, and
  an electrical contact supported coaxially within the cavity of the receptacle insulator;
  wherein the plug assembly and receptacle assembly are configured to be engageable with each other, with the contact of the plug assembly electrically coupled with the contact of the receptacle assembly, and with the cylindrical nose positioned within the cylindrical cavity, an annular space being defined between the nose and the cavity side wall; and a resilient dielectric seal fitted either onto the cylindrical nose or within the cylindrical cavity such that the seal is interposed in the annular space defined between the nose and the cavity side wall when the plug assembly and receptacle assembly are engaged with each other, wherein the seal has a prescribed nominal radial thickness profile sized such that the plug assembly and receptacle assembly can engage each other without substantial sliding resistance;

wherein, when the plug assembly and receptacle assembly are engaged to the extent that the contacts of the two assemblies are fully mated, the cylindrical seal compressor of the plug body can be advanced toward the receptacle assembly, to longitudinally compress the resilient dielectric seal and thereby increase the seal's nominal radial thickness profile until the seal substantially fills the annular space between the nose and the cavity side wall.

11. An electrical connector as defined in claim 10, wherein the plug assembly and receptacle assembly, together, further include a rotatable coupling nut and mating threads, for tightening the engagement between the plug and receptacle assemblies and simultaneously advancing the cylindrical seal compressor of the plug body toward the receptacle assembly.

12. An electrical connector as defined in claim 11, wherein:

rotation of the coupling nut relative to the mating threads advances the plug body and seal compressor of the plug assembly toward the receptacle assembly while the plug insulator and nose retract relative thereto; and plug assembly further includes a compression spring that yieldably resists retraction of the plug insulator and nose relative to the plug body and seal compressor.

13. An electrical connector as defined in claim 11, wherein:

the plug assembly further includes a compression spring that yieldably resists retraction of the plug insulator and nose relative to the plug body and seal compressor; and the plug body and seal compressor are integral with each other.

14. A method for providing a high-voltage seal around mating electrical contacts of a plug assembly and a receptacle assembly, wherein the plug assembly includes a plug insulator having a generally cylindrical nose and the receptacle assembly includes a receptacle insulator defining a generally cylindrical cavity, wherein the plug assembly and receptacle assembly both are formed of a substantially non-resilient dielectric material and are configured to be engageable with each other with the nose positioned within the cavity and with the contact of the plug assembly electrically coupled with the contact of the receptacle assembly, an annular space being defined between the cylindrical nose and the cylindrical cavity side wall, wherein the method comprises the steps of:

fitting a resilient dielectric seal either onto the cylindrical nose or within the cylindrical cavity such that the seal is interposed in the annular space defined between the nose and the cavity side wall when the plug assembly and receptacle assembly are engaged with each other, wherein the seal has a prescribed nominal radial thickness profile sized such that the plug assembly and receptacle assembly can engage each other without substantial sliding resistance; and after the step of fitting, increasing the nominal radial thickness profile of the dielectric seal until it substantially fills the annular space between the cylindrical nose and the cylindrical cavity side wall.

15. A method as defined in claim 14, wherein:

the resilient dielectric seal is substantially cylindrical;

the plug assembly further includes a cylindrical seal compressor encircling a portion of the nose and abutting one end of the resilient dielectric seal; and the method further includes a step of moving the cylindrical seal compressor toward the resilient dielectric seal, after the plug assembly and receptacle assembly have engaged each other, to compress the seal longitudinally and thereby increase the seal's nominal radial thickness profile.

16. A method as defined in claim 15, wherein:

the plug assembly and receptacle assembly, together, further include a rotatable coupling nut and mating threads; and the step of moving the cylindrical seal compressor includes rotating the coupling nut relative to the mating threads, to tighten the engagement between the plug assembly and receptacle assembly and simultaneously move the cylindrical seal compressor relative to the nose, thereby compressing the resilient dielectric seal longitudinally.

17. A method as defined in claim 16, wherein:

the plug assembly further includes a plug body encircling a portion of the nose;

the step of rotating the coupling nut relative to the mating threads advances the plug body and the cylindrical seal compressor toward the receptacle assembly while the plug insulator and nose retract relative thereto; and the plug assembly further includes a compression spring for yieldably resisting retraction of the nose relative to the plug body and cylindrical seal compressor.

* * * * *